US009048590B2

(12) United States Patent
Wetzel et al.

(10) Patent No.: US 9,048,590 B2
(45) Date of Patent: Jun. 2, 2015

(54) CONNECTING APPARATUS FOR TRANSMITTING HIGH-VOLTAGE CURRENT IN THE MOTOR VEHICLE SECTOR

(71) Applicant: Dr. Ing. h. c. F. Porsche Aktiengesellschaft, Stuttgart (DE)

(72) Inventors: Timo Wetzel, Bad Rappenau (DE); Peter Bormuth, Bensheim (DE)

(73) Assignee: Dr. Ing. h.c. F. Porsche Aktiengesellschaft (DE)

( * ) Notice: Subject to any disclaimer, the term of this patent is extended or adjusted under 35 U.S.C. 154(b) by 6 days.

(21) Appl. No.: 14/063,244

(22) Filed: Oct. 25, 2013

(65) Prior Publication Data

US 2014/0120772 A1 May 1, 2014

(30) Foreign Application Priority Data

Oct. 26, 2012 (DE) ..... 10 2012 110 233

(51) Int. Cl.
*H01R 9/03* (2006.01)
*H01R 13/6592* (2011.01)
*H01R 13/6596* (2011.01)

(52) U.S. Cl.
CPC ..... *H01R 13/6592* (2013.01); *H01R 13/6596* (2013.01)

(58) Field of Classification Search
CPC ..... H01R 4/646; H01R 13/5219; H01R 13/6215; H01R 13/5202; H01R 13/5208; H01R 13/5205; H01R 13/658; H01R 23/7073
USPC ..... 439/98, 271, 364, 559, 587, 589, 439/607.41, 660, 939
See application file for complete search history.

(56) References Cited

U.S. PATENT DOCUMENTS 4,295,701 A 10/1981 Gunn
5,800,195 A * 9/1998 Endo et al. ..... 439/271
5,971,811 A * 10/1999 Mori et al. ..... 439/675

(Continued)

FOREIGN PATENT DOCUMENTS

DE 10 2006 007 604 8/2007
JP 8-64306 3/1996

(Continued)

OTHER PUBLICATIONS

German Search Report of Jun. 27, 2013.

*Primary Examiner* — Thanh Tam Le
(74) *Attorney, Agent, or Firm* — Gerald E. Hespos; Michael J. Porco; Matthew T. Hespos

(57) ABSTRACT

A connecting apparatus for transmitting high-voltage current in a motor vehicle has a first connector (4), a second connector (6) and a shielding housing (12). The first connector (4) has at least one housing arrangement (20) with a first insulating housing (21) with at least one first contact (18) that is connected electrically to an internal conductor (16) of a cable (14), and has a shielding arrangement (28) connected to a shield (30) of the cable (14). The shielding arrangement (28) is connected to the shielding housing (12) by a shielding part (32). The second connection element (6) has at least one second housing arrangement (41) with a second insulating housing part (42) and at least one second contact (46) connected to a current line element. The shielding part (32) is a shielding sleeve (34) with a spring ring (36).

10 Claims, 2 Drawing Sheets

(56) References Cited

U.S. PATENT DOCUMENTS

| | | | | |
|---|---|---|---|---|
| 6,358,069 | B2 * | 3/2002 | Yoshioka et al. | 439/108 |
| 6,702,611 | B1 | 3/2004 | Miyazaki et al. | |
| 7,753,734 | B2 | 7/2010 | Eckel et al. | |
| 7,854,629 | B1 * | 12/2010 | Albers et al. | 439/589 |
| 7,988,475 | B2 | 8/2011 | Sakakura | |
| 8,460,015 | B2 * | 6/2013 | Deno et al. | 439/98 |
| 2001/0027040 | A1 | 10/2001 | Yoshioka et al. | |
| 2010/0178798 | A1 | 7/2010 | Rosenberger | |
| 2012/0329324 | A1 | 12/2012 | Hoeppner | |

FOREIGN PATENT DOCUMENTS

| | | |
|---|---|---|
| JP | 8-78098 | 3/1996 |
| JP | 20000150074 | 5/2000 |
| JP | 2008-262811 | 10/2008 |
| JP | 2009043704 | 2/2009 |

* cited by examiner

CONNECTING APPARATUS FOR TRANSMITTING HIGH-VOLTAGE CURRENT IN THE MOTOR VEHICLE SECTOR

CROSS REFERENCE TO RELATED APPLICATION

This application claims priority under 35 USC 119 to German Patent Appl. No. 10 2012 110 233.3 filed on Oct. 26, 2012, the entire disclosure of which is incorporated herein by reference.

BACKGROUND

1. Field of the Invention

The invention relates to a connecting apparatus for transmitting high-voltage current in a motor vehicle.

2. Description of the Related Art

A large number of connecting apparatuses for transmitting current and/or high-voltage current are known from the fields of electrical engineering and electronics. Shielding the cable and the connecting apparatus that emits electromagnetic interference signals plays an important role, particularly when transmitting high-voltage current. This applies particularly in the motor vehicle sector where an extremely wide variety of types of electric motors, actuators and the associated cables are laid in an extremely small installation space. High-voltage technology also has entered the motor vehicle sector due to recent developments of hybrids and to the development in the field of electric motors and fuel cells. Against the background of series and/or mass production, requirements are becoming more stringent with respect to the structure and shielding of a connecting apparatus of this kind, while allowing the connecting apparatuses to be fit in a simple and cost-effective manner. DE 10 2006 007 604 A1 discloses a connecting apparatus for transmitting high-voltage current in a motor vehicle. The connecting apparatus has a shield of simplified construction and can be fit in conditions that are difficult in respect of installation space. However, this connecting apparatus still is very complex in respect of fitting, particularly against the background of a shield functioning without problems due to the particular type of fixing.

Therefore, the object of the invention is to provide a simplified connecting apparatus for transmitting high-voltage current in a motor vehicle, which connecting apparatus ensures optimum shielding while meeting requirements in respect of robustness and service life.

SUMMARY OF THE INVENTION

The invention relates to a connecting apparatus with at least one first connection element, at least one second connection element, at least one shielding housing and fixing means. The first connection element has at least one first housing arrangement with a first insulating housing having at least one first contact that is connected electrically to an internal conductor of a cable, and a shielding arrangement is connected to a shield of the cable. The shielding arrangement is connected to the shielding housing by a shielding part. The second connection element has at least one second housing arrangement with a second insulating housing having at least one second contact element that is connected electrically to a current line. The shielding part preferably is a shielding sleeve with a spring ring. In this way, the first connection element always is kept under prestress in the connecting apparatus. Thus, optimum shielding is ensured even under an extremely wide variety of loads.

The shielding housing preferably comprises a flange and can have a bearing face for the spring ring. The shielding arrangement can have a crimped sleeve to ensure an adequate electrical connection between the shield and the shielding sleeve.

The second connection element preferably is arranged on that side of the shielding housing part that is averted from the first connection element.

The first insulating housing advantageously is produced from plastic and is connected to the shielding housing part by removable fixing members, such as screws. The second insulating housing part also advantageously can be produced from plastic and can be connected to the shielding housing part by removable fixing members, such as screws.

Two or more first and second connection elements may be provided. In this situation, coding can be provided to ensure correct connection of the respective first and/or second connection elements. The coding can comprise interlocking members or color identifiers.

The first contact element preferably is a socket and the second contact element preferably is a pin to produce a plug-like connecting arrangement that is simple to produce.

The first connection element can have a shock protector. The shock protector can be colored so that the above-mentioned coding also is ensured. The shock protector can have a latch that interacts with a corresponding latch of the second insulating housing.

The invention will be explained in greater detail below with reference to the drawings.

DETAILED DESCRIPTION OF THE PREFERRED EMBODIMENTS

Figure 1:
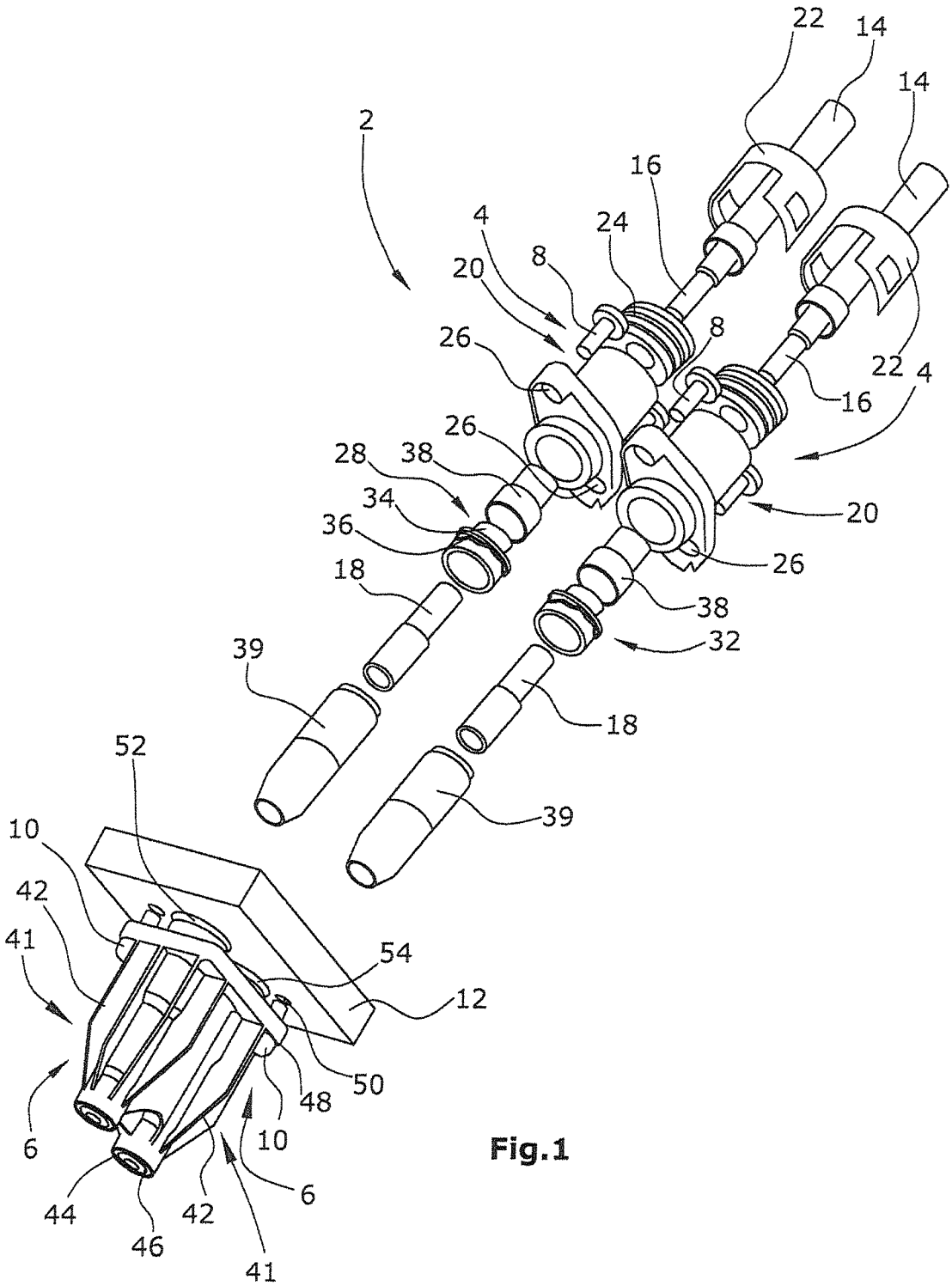
FIG. 1 is an exploded perspective view of a connecting arrangement according to the invention.

FIG. 1 is an exploded perspective view of a connecting apparatus 2 according to the invention for transmitting high-voltage current in a motor vehicle. The connecting apparatus 2 is a plug connection in the form of a pin-and-socket connection, but other types of connection also are possible within the scope of the invention. The connecting apparatus 2 has two first connection elements 4 and two second connection elements 6 that engage one another and are fixed to a shielding housing 12 by fixing members 8, 10, such as screws. The second connection element 6 is arranged on the side of the shielding housing 12 that is averted from the first connection element 4.

Figure 2:
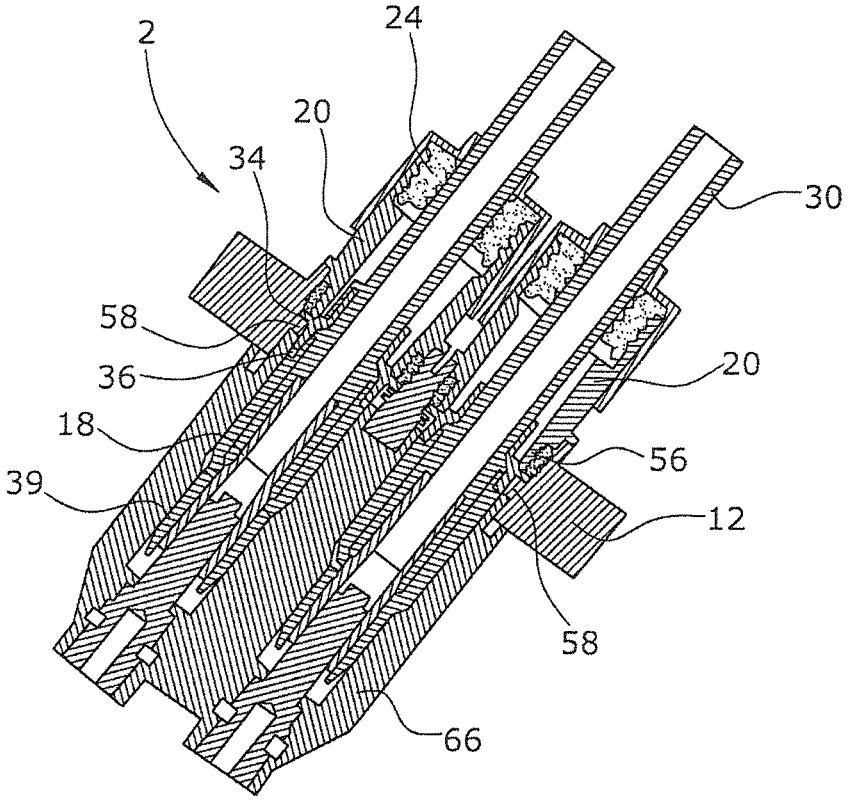
FIG. 2 is a sectional view through the fitted connecting arrangement of FIG. 1.

The first connection element 4 is connected to a high-voltage current cable 14. To this end, an internal conductor 16 is connected to a first contact element 18, which is designed as a round socket-like contact. Furthermore, the first connection element 4 has a first insulating housing 20 with a cap 22 and a seal 24 on the side directed toward the cable 14. In the present embodiment, the first insulating housing 20 is produced from plastic and has holes 26 for receiving the screws 8 to engage with corresponding threaded holes in the shielding housing 12. A shielding arrangement 28 is connected to a shield 30, as shown in FIG. 2. In this embodiment, the shielding arrangement 28 has a shielding part 32 that has a shielding sleeve 34 with a spring ring 36. As a result, the shielding sleeve 34 always bears against the shielding housing part 12 under prestress and thereby ensures optimum shielding together with optimum functional reliability since the connection arrangement 4 also is held under prestress in this way. A crimping sleeve 38 completes the shielding arrangement 28 and ensures strain-relieving insulation crimping of the cable, wherein shielding crimping is ensured at the same time. The first contact element 18 also has a shock protector 39 that can be of different colors to prevent connection errors during fitting by means of coding. The first insulating housing 20 also can have coding in the form of geometric projections that interact with corresponding recesses in the shielding housing part 12 in a way to prevent incorrect fitting. Second connection elements 6 are provided on the side of the shielding housing part 12 that is averted from the high-voltage current cable. The second connection elements 6 have a second insulating housing 42. The second connection elements 6 and the second insulating housing 42 are connected to one another by a connecting piece 44. A second contact element 46 which is designed as a current line element in the present case is provided in the second insulating housing 42 in a known manner. The second connection element 6 has holes 48 through which the screws 10 extend and engage with corresponding threaded holes 50. Simple but reliable fitting is ensured here by coding 52 designed in the form of a pin and engages in a corresponding hole 54 in the shielding housing 12.

FIG. 2 now shows a sectional view through the connecting apparatus of FIG. 1 in the fitted state. It can clearly be seen in FIG. 2 that the shielding housing 12 is in the form of a flange part that has projecting bearing faces 56 corresponding to the respective first insulating housing 20 in such a way that simple fitting is made possible, and also has recessed bearing faces 58 that correspond to the spring ring 36 of the shielding arrangement 28 to ensure optimum shielding.

What is claimed is:

1. A connecting apparatus for transmitting high-voltage current in a motor vehicle, comprising:

at least one first connection element;

at least one second connection element; and at least one shielding housing, wherein:

the second connection element has at least one second housing arrangement with a second insulating housing and at least one second contact element disposed in the second insulating housing and connected to a current line; and the first connection element has at least one housing arrangement with a first insulating housing and at least one first contact disposed in the first insulating housing and connected electrically to an internal conductor of a cable, the first connection element further having at least one shielding arrangement connected to a shield of the cable, the shielding arrangement being connected to the shielding housing by a shielding part that includes a shielding sleeve and a spring ring thereon.

2. The connecting apparatus of claim 1, wherein the shielding housing comprises a flange.

3. The connecting apparatus of claim 1, wherein the shielding housing has a bearing face for engaging the spring ring.

4. The connecting apparatus of claim 3, wherein the shielding arrangement further comprises has a crimped sleeve.

5. The connecting apparatus of claim 1, wherein the second connection element is arranged on a side of the shielding housing averted from the first connection element.

6. The connecting apparatus of claim 1, characterized in that the first insulating housing is produced from plastic and is connected to the shielding housing by removable fixing members.

7. The connecting apparatus of claim 6, wherein the second insulating housing is produced from plastic and is connected to the shielding housing by removable fixing members.

8. The connecting apparatus of claim 1, wherein the at least one first connection element comprises plural first connection elements and the at least one second connection element comprises plural second connection elements, the connecting apparatus further comprising coding to ensure correct connection of the respective first and second connection elements.

9. The connecting apparatus of claim 1, wherein the first contact element is a socket and the second contact element is a pin.

10. The connecting apparatus of claim 1, wherein the first connection element has a shock protector.

* * * * *